US005614478A

United States Patent [19]

Gates

[11] Patent Number: 5,614,478

[45] Date of Patent: Mar. 25, 1997

[54] AEROSOL GREASE

[75] Inventor: Stephen E. Gates, Dublin, Ohio

[73] Assignee: Aerospace Lubricants, Inc., Columbus, Ohio

[21] Appl. No.: 372,388

[22] Filed: Jan. 13, 1995

[51] Int. Cl.[6] ..... C10M 113/10; C10M 123/00

[52] U.S. Cl. ..... 508/136; 508/382; 508/463; 508/539; 508/552; 508/591

[58] Field of Search ..... 252/38, 39; 508/136

[56] References Cited

U.S. PATENT DOCUMENTS 3,669,884 6/1972 Wright ..... 252/36
3,982,920 9/1976 Cross et al. ..... 252/38
4,312,424 1/1982 Taylor et al. ..... 184/6.4
4,443,348 4/1984 Wright et al. ..... 252/37.2
5,358,179 10/1994 Lund et al. ..... 239/333

*Primary Examiner*—Ellen M. McAvoy
*Attorney, Agent, or Firm*—Standley & Gilcrest

[57] ABSTRACT

The present invention includes an aerosol grease precursor composition adapted to be sprayed and a pressurized aerosol grease precursor composition in a dispensing container. The present invention also includes a method of dispensing an aerosol grease composition.

41 Claims, No Drawings

AEROSOL GREASE

TECHNICAL FIELD

The present invention is in the field of sprayable lubricant compositions.

BACKGROUND

Sprayable lubricants are very useful in a wide variety of applications from industrial to household environments. Such lubricants offer the convenience of portability and storage when packaged in standard sized aerosol cans or other spray containers.

These products are light, low viscosity lubricant products used chiefly for light lubrication and as penetrating oils to free rusted or seized parts. Such products do not offer the advantages and lubricant performance of a lubricant product of a grease consistency.

Normally, a stiff grease product has to be mixed with a solvent in order that it be made thin enough to be filled into an aerosol can and sprayed out.

One disadvantage of this method is that the target grease must be finally rendered before so solvated and packaged.

Another of the drawbacks of both sprayable light oils and spray grease products is that the sprayable aerosol mixtures typically incorporate solvents that are often toxic, flammable or fall into the class of compounds known as Ozone Depleting Chemicals ("ODC's"). ODC's have come under much greater environmental scrutiny, and their use already has been banned or restricted in some states.

Therefore, it is an object of the present invention to produce lubricant products of a grease consistency in a conveniently dispensable, sprayable form.

It is also advantageous to be able to produce a lubricant product of a grease consistency using fewer processing steps than typically involved in grease production.

It is also desirable to be able to produce such lubricant products of a grease consistency using a minimum of chemical components, and without the use of solvents.

In view of the present disclosure and/or through practice of the present invention, other advantages and the solutions to other problems may become apparent.

SUMMARY OF THE INVENTION

The present invention includes an aerosol grease precursor composition adapted to be sprayed and a pressurized aerosol grease precursor composition in a dispensing container. The present invention also includes a method of dispensing an aerosol grease composition.

The aerosol grease precursor composition of the present invention comprises: (a) at least one substantially unprocessed grease precursor (typically those capable of forming a grease of an NLGI Grade in the range of 000 to 6; preferably in the range of 0 to 2); (b) at least one thickening agent; and (c) at least one propellant. The aerosol grease precursor composition is substantially free of liquid organic solvents and is under a pressure greater than ambient atmospheric pressure.

As used herein, the term "grease precursor" is intended to include any petroleum-derived or synthetic substance which may be processed into a grease through mechanical processing, such as shearing, or through chemical processing. Such substances include petroleum oils and synthetic hydrocarbons and oils, such as napthenic oils, poly-α-olefins, esters (mono-, di-, and tri-esters) and polyol esters, or mixtures thereof. Of these, poly-α-olefins are preferred. Such compounds are sometimes referred to as mineral bases or base oils.

The thickening agents which may be used in accordance with the present invention include polyureas, lithium, aluminum complexes, calcium soaps, clays, silicas, FEP, PTFE resins, ureas and mixtures of any two or more thereof. Of these, clays are preferred. The preferred percent composition of the thickening agent(s) in the aerosol grease precursor composition of the present invention is from about 8% to about 20% of said composition. The thickening agent may be selected to achieve the desired performance in terms of anti-rust, Cu protection, anti-oxidation protection, EP and/or anti-wear protection properties.

In manufacturing grease products, base oils are added to a processing tank and the appropriate thickener and additives are then incorporated. A catalyst is then added and heat is applied with agitation to keep the product in suspension and to prevent over-heating the product along the sides of the reaction vessel. When the correct temperature is reached, the product is pumped by low shear methods to a storage tank and held for a predetermined time. The product is then pumped, again by low shear methods, to a machine that induces a high (mechanical) shear on the product, causing it to gel into what is referred to as a NLGI #2 grease (for instance).

One of the ways a grease precursor of the present invention may be produced is to incorporate a time- and shear-sensitive thickener into a base oil with the appropriate additives, such as thickeners. The aforementioned heating process is then halted at a point prior to the end of the normal heating period. The grease precursor is then transferred into containers by low shear techniques for shipment to the packager, if distant from the point of production. In a preferred embodiment, the aforementioned heating of the grease precursor may actually be done at a lower temperature than is typical. For instance, the mixture may be heated at a temperature of only about 100° F. rather than a more typical 220° F. Also, the amounts of thickener may be reduced below normal amounts. For instance, about 7% thickener instead of about 11% thickener may be used.

Time duration before final packaging is preferably less than eight (8) days as the grease precursor will tend to thicken with age.

The propellants that may be used in accordance with the present invention include such substances as isobutane, butane, propane, nitrogen, carbon dioxide, nitrogen dioxide, hydrofluorocarbons (HFC), hydrochlorofluorocarbons (HCFC), dimethyl ether and mixtures of any two or more thereof. Most preferred of these is a blend of isobutane/propane in the ratio 50:50. The preferred percent composition of the propellant in the aerosol grease precursor composition of the present invention is from about 18% to about 90% of said composition. Naturally, it is preferred that the container have enough propellant to expel the container contents, an amount that may be arrived at through known methods.

The present invention also includes a pressurized aerosol grease precursor composition in a dispensing container which comprises: (a) at least one substantially unprocessed grease precursor as described above; (b) at least one thickening agent as described above; and (c) at least one propellant as described above. The inventive composition is substantially free of liquid organic solvents and is under a pressure greater than ambient atmospheric pressure.

The composition is placed in a container adapted to contain the pressurized aerosol grease precursor. The container comprises an outlet and a valve to control the release of said pressurized aerosol grease precursor from the container. The containers used in accordance with the present invention may be selected from any appropriate type of pressurizable container. Such containers will typically be a standard aerosol can with an appropriately sized aperture and valve mechanism. The volume of such an aerosol container may vary from a few ounces (i.e., 2 or 3 ounces) to greater volumes of about 10 to 30 ounces. The amount of the inventive composition dispensed into the container will naturally vary with the container's volume capacity. As an alternative, the container may be of any other construction that will allow its contents to be sprayed or otherwise urged out under pressure, such as a container adapted to be pressurized by a compressor or other pressurizing means. Such alternative containers may be those adapted for professional or industrial use, and may be of greater volume than those typically used in hand-held aerosol cans.

The dispensing aperture of the spray valve may be any length or diameter sufficient to bring to bear sufficient shearing forces on the grease precursor being urged therethrough. Of course, this will depend on the nature of the specific grease precursor chosen and the desired final grease viscosity. These parameters may be determined by calculating the shear forces attendant to the spraying of the grease precursor through the given aperture and at the given pressure to arrive at a shear rate profile to achieve a grease of a given viscosity from that given precursor, and comparing those forces to that normally used to render that given grease precursor to a grease under normal production circumstances. Typical of the aperture diameters that may be used in the dispensing container of the present invention where that container is a typical aerosol can under typical aerosol pressures, are those in the range of from about 0.00010 of an inch to about 0.00050 of an inch, preferably 0.00025 of an inch. Typical of the pressures at which such aerosol containers are used are those in the range of from about 60 to about 90 psi, preferably about 70 psi for the preferred embodiment discussed below. Typical of the flow rates for the material through the aerosol canister valve aperture are those in the range from about 50 to about 120 grams per minute, preferably about 90 grams per minute.

The composition may be placed in the container using known filling techniques and apparatus.

The grease produced in accordance with the present invention may be of any NLGI index from 000 to 5, but is preferably in the range of 0 to 2, most preferably 2. The NLGI index of the grease produced in accordance with the present invention may be achieved by varying the amount and type of the grease precursor(s) and the thickening agent(s).

The aerosol grease precursor composition of the present invention may then be subjected to sufficient shearing forces that cause it to gel, rendering it to a grease consistency.

Accordingly, the aerosol grease precursor composition of the present invention may be subjected to a method of dispensing an aerosol grease composition, the method comprising: (a) obtaining a pressurized aerosol grease precursor composition in a dispensing container as described above, the composition comprising: (1) at least one substantially unprocessed grease precursor; (2) at least one thickening agent; and (3) at least one propellant; the composition being substantially free of liquid organic solvents and being under a pressure greater than ambient atmospheric pressure; and (b) opening the valve of the dispensing container so as to cause said pressurized aerosol grease precursor composition to be released from said container whereby the unprocessed grease precursor(s) and the thickening agent(s) form a grease.

DETAILED DESCRIPTION OF THE PREFERRED EMBODIMENT

In accordance with the foregoing summary, the following is a detailed description of the preferred embodiment of the proposed invention which is also considered to be the best mode.

The following Examples show several detailed embodiments of the preferred formulation of the invention.

EXAMPLE 1

The components of the Example 1 formulation are as follows:

| Component Type | Chemical Compound | Percent By Weight |
|---|---|---|
| Base Oil | 6cSt PAO | 88.75% |
| Thickener | Bentone-34 | 10.0% |
| Anti-rust Compound | Vanlube OD-9011 | 0.75% |
| Cu passivator | Reomet 39 | 0.5% |
| Catalyst | Acetone | (1.0%) |
| Catalyst | Water | (0.1%) |

To produce the formulation of Example 1, the base oil is pumped into an appropriately sized vat with heating capability. The thickener may then be added and mixed for a suitable amount of time to disperse the thickener in the base oil. The anti-rust ingredient and the cu passivator may then be added and mixed for a suitable amount of time to disperse these additives. The two catalysts may then be added and stirred for a suitable amount of time to disperse them. The mixture is then heated to an appropriate temperature to allow thickening to occur (typically about 150° F.). The resultant product is then removed from the vat without shearing and placed in shipping containers. The product may be then shipped to an aerosol packager. Where industrial capabilities allow, the product may of course be packaged into an aerosol container on site. Aerosol cans may be filled with the unsheared product, and provided with a propellant. Propellant/grease ratios of 10:90; 15:85; 20:80; 20:72; and 50:50 were prepared. It was found that the formulation of Example 1, regardless of the propellant/grease ratio, ran when sprayed on to a surface. It was also found that less than 15% propellant was not sufficient to expel all of the product from the aerosol can at sufficient velocity to achieve the desired shearing effect.

EXAMPLES 2–4

The components of the Example 2 formulation are as follows:

| Component Type | Chemical Compound | Percent By Weight |
|---|---|---|
| Base Oil | 6cSt PAO | 87.75% |
| Thickener | Bentone-34 | 11.0% |
| Anti-rust Compound | Vanlube 0D-9011 | 0.75% |
| Cu passivator | Reomet 39 | 0.5% |
| Catalyst | Acetone | (1.0%) |
| Catalyst | Water | (0.1%) |

The components of the Example 3 formulation are as follows:

| Component Type | Chemical Compound | Percent By Weight |
|---|---|---|
| Base Oil | 6cSt PAO | 85.75% |
| Thickener | Bentone-34 | 13.0% |
| Anti-rust Compound | Vanlube OD-9011 | 0.75% |
| Cu passivator | Reomet 39 | 0.5% |
| Catalyst | Acetone | (1.0%) |
| Catalyst | Water | (0.1%) |

The components of the Example 4 formulation are as follows:

| Component Type | Chemical Compound | Percent By Weight |
|---|---|---|
| Base Oil | 6cSt PAO | 82.75% |
| Thickener | Bentone-34 | 16.0% |
| Anti-rust Compound | Vanlube OD-9011 | 0.75% |
| Cu passivator | Reomet 39 | 0.5% |
| Catalyst | Acetone | (1.0%) |
| Catalyst | Water | (0.1%) |

The formulations of Examples 2–4 given above were prepared using the same process as outlined with respect to the formulation of Example 1. The product arising from the formulations of Examples 2–4 were dispensed into aerosol canisters using gravity-fed filling machines, It was found that the formulation of Example 2 was the thickest that such machines could handle to achieve efficient production fill times. The same products of the formulations of Examples 2–4 were also dispensed into aerosol canisters using filling machines which comprised positive displacement pumps. It was found that the products of all three formulations could be filled efficiently, and it was even felt that more viscous products then those produced in accordance with the formulation of Example 4 could be dispensed using such equipment.

The product from the formulation of Example 2 was chosen for production with a propellant/grease ratio of 28:72. The preferred propellant being a blend of isobutane and propane. This formulation was also evaluated with propellant/grease ratios of 35:65; 40:60; 50:50; 70:30; and 90:10, respectively. It was found that the relatively higher propeller content produced a better spray pattern, less splatter and better penetrating capability. At a 90:10 ratio, the product was found to be susceptible to running.

In accordance with the guidance provided above, one or ordinary skill in the art may be able to adjust the propellant/grease ratio in order to achieve the desired spray pattern, splatter characteristics and penetrating capabilities. For instance, it may be desirable to produce an aerosol spray grease which has greater running characteristics for use where this characteristic is a benefit, such as in the lubrication of fine tools, such as dental instruments.

Aerosol spray products may be incorporated in spray containers of any volume appropriate to the intended use. Such containers may range from small containers for hand-held domestic and industrial use, to large tanks which may be used in industry production plants or service stations.

In light of the foregoing disclosure, it will be within the ability of one skilled in the lubricant formulating art to make modifications to the present invention, such as through the substitution of equivalent chemicals, compounds and their concentrations, or the application of equivalent process steps, without departing from the spirit of the invention.

What is claimed is:

1. An aerosol grease precursor composition, said composition comprising:

(a) a substantially unprocessed grease precursor composition, said grease precursor composition comprising:
(i) at least one grease precursor base oil; and
(ii) at least one thickening agent;
said grease precursor composition capable of forming a grease of an NLGI Grade in the range of 000 to 6 upon mechanical shearing attendant to aerosol spraying: and (b) at least one propellant;

said aerosol grease precursor composition being substantially free of liquid organic solvents and being under a pressure greater than ambient atmospheric pressure.

2. An aerosol grease precursor composition according to claim 1 wherein said at least one substantially unprocessed grease precursor comprises a substance selected from the group consisting of petroleum oils, synthetic hydrocarbons, napthenic oils, poly-alpha-olefins, mono-esters, di-esters, tri-esters, polyol esters, and mixtures of any two or more thereof.

3. An aerosol grease precursor composition according to claim 1 wherein said at least one thickening agent comprises a substance selected from the group consisting of polyureas, lithium, aluminum complexes, calcium soaps, clays, and mixtures of any two or more of said thickening agents.

4. An aerosol grease precursor composition according to claim 1 wherein said at least one propellant comprises a substance selected frown the group consisting of isobutane, butane, propane, nitrogen, carbon dioxide, and mixtures of any two or more of said propellants.

5. An aerosol grease precursor composition according to claim 1 wherein said at least one propellant comprises a mixture of isobutane and propane in a ratio of 50:50.

6. An aerosol grease precursor composition according to claim 1 wherein said at least one propellant comprises from about 18% to about 90% of said aerosol grease precursor composition.

7. An aerosol grease precursor composition according to claim 1 wherein said at least one substantially unprocessed grease precursor base oil and said at least one thickening agent taken together comprise from about 10% to about 82% of said aerosol grease precursor composition.

8. A pressurized aerosol grease precursor composition in a dispensing container, comprising:

(a) a substantially unprocessed grease precursor composition, said grease precursor composition comprising:
(i) at least one grease precursor base oil; and
(ii) at least one thickening agent;
said grease precursor composition capable of forming a grease of an NLGI Grade in the range of 000 to 6 upon mechanical shearing attendant to aerosol spraying: and (b) at least one propellant;

said aerosol grease precursor composition being substantially free of liquid organic solvents and being under a pressure greater than ambient atmospheric pressure; and said aerosol grease precursor composition disposed in a container adapted to contain said pressurized aerosol grease precursor composition, said container comprising an outlet and a valve to control the release of said pressurized aerosol grease precursor composition from said container.

9. A pressurized aerosol grease precursor composition in a dispensing container according to claim 8 wherein said at least one substantially unprocessed grease precursor comprises a substance selected from the group consisting of petroleum oils, synthetic hydrocarbons, napthenic oils, poly-alpha-olefins, mono-esters, di-esters, tri-esters, polyol esters, and mixtures of any two or more thereof.

10. A pressurized aerosol grease precursor composition in a dispensing container according to claim 8 wherein said at least one thickening agent comprises a substance selected from the group consisting of polyureas, lithium, aluminum complexes, calcium soaps, clays, and mixtures of any two or more of said thickening agents.

11. A pressurized aerosol grease precursor composition in a dispensing container according to claim 8 wherein said at least one propellant comprises a substance selected from the group consisting of isobutane, butane, propane, nitrogen, carbon dioxide, and mixtures of any two or more of said propellants.

12. A pressurized aerosol grease precursor composition in a dispensing container according to claim 8 wherein said at least one propellant comprises a mixture of isobutane and propane in a ratio of 50:50.

13. A pressurized aerosol grease precursor composition in a dispensing container according to claim 8 wherein said at least one propellant comprises from about 18% to about 90% of said aerosol grease precursor composition.

14. A pressurized aerosol grease precursor composition in a dispensing container according to claim 8 wherein said at least one grease precursor base oil and said at least one thickening agent taken together comprise from about 10% to about 82% of said aerosol grease precursor composition.

15. A method of dispensing an aerosol grease composition, said method comprising:

(a) obtaining a pressurized aerosol grease precursor composition in a dispensing container, said aerosol grease precursor composition comprising:

(i) a substantially unprocessed grease precursor composition, said grease precursor composition comprising:
(1) at least one grease precursor base oil; and
(2) at least one thickening agent;

said grease precursor composition capable of forming a grease of an NLGI Grade in the range of 000 to 6 upon mechanical shearing attendant to aerosol spraying; and (ii) at least one propellant;

said aerosol grease precursor composition being substantially free of liquid organic solvents and being under a pressure greater than ambient atmospheric pressure; and said aerosol grease precursor composition disposed in a conger adapted to contain said pressurized aerosol grease precursor, said container comprising an outlet and a valve to control the release of said pressurized aerosol grease precursor from said container; and (b) opening said valve so as to cause said pressurized aerosol grease precursor composition to be released from said container whereby said grease precursor composition forms a grease.

16. A method according to claim 15 wherein said at least one grease precursor base oil comprises a substance selected from the group consisting of petroleum oils, synthetic hydrocarbons, napthenic oils, poly-alpha-olefins, mono-esters, di-esters, tri-esters, polyol esters, and mixtures of any two or more thereof.

17. A method according to claim 15 wherein said at least one thickening agent comprises a substance selected from the group consisting of polyureas, lithium, aluminum complexes, calcium soaps, clays, and mixtures of any two or more of said thickening agents.

18. A method according to claim 15 wherein said at least one propellant comprises a substance selected from the group consisting of isobutane, butane, propane, nitrogen, carbon dioxide, nitrogen dioxide, hydrofluorocarbons, dimethyl ether, HFC, HCFC and mixtures of any two or more of said propellants.

19. A method according to claim 15 wherein said at least one propellant comprises from about 18% to about 90% of said aerosol grease precursor composition.

20. A method according to claim 15 wherein said at least one grease precursor base oil and said at least one thickening agent taken together comprise from about 10% to about 82% of said aerosol grease precursor composition.

21. An aerosol grease precursor composition, said composition consisting essentially of:

(a) a substantially unprocessed grease precursor composition, said grease precursor composition comprising:
(i) at least one grease precursor base oil; and
(ii) at least one thickening agent;

said grease precursor composition capable of forming a grease of an NLGI Grade in the range of 000 to 6 upon mechanical shearing attendant to aerosol spraying; and (b) at least one propellant;

said aerosol grease precursor composition being substantially free of liquid organic solvents and being under a pressure greater than ambient atmospheric pressure.

22. An aerosol grease precursor composition according to claim 21 wherein said at least one grease precursor base oil comprises a substance selected from the group consisting of petroleum oils, synthetic hydrocarbons, napthenic oils, poly-alpha-olefins, mono-esters, di-esters, tri-esters, polyol esters, and mixtures of any two or more thereof.

23. An aerosol grease precursor composition according to claim 21 wherein said at least one thickening agent comprises a substance selected from the group consisting of polyureas, lithium, aluminum complexes, calcium soaps, clays, and mixtures of any two or more of said thickening agents.

24. An aerosol grease precursor composition according to claim 21 wherein said at least one propellant comprises a substance selected from the group consisting of isobutane, butane, propane, nitrogen, carbon dioxide, and mixtures of any two or more of said propellants.

25. An aerosol grease precursor composition according to claim 21 wherein said at least one propellant comprises from about 18% to about 90% of said aerosol grease precursor composition.

26. An aerosol grease precursor composition according to claim 21 wherein said at least one grease precursor base oil and said at least one thickening agent taken together comprise from about 10% to about 82% of said aerosol grease precursor composition.

27. A pressurized aerosol grease precursor composition in a dispensing container, comprising a mixture consisting essentially of:

(a) a substantially unprocessed grease precursor composition, said grease precursor composition comprising:
(i) at least one grease precursor base oil; and
(ii) at least one thickening agent;

said grease precursor composition capable of forming a grease of an NLGI Grade in the range of 000 to 6 upon mechanical shearing attendant to aerosol spraying: and (b) at least one propellant;

said aerosol grease precursor composition being substantially free of liquid organic solvents and being under a pressure greater than ambient atmospheric pressure; and said aerosol grease precursor composition disposed in a container adapted to contain said pressurized aerosol grease precursor composition, said container comprising an outlet and a valve to control the release of said pressurized aerosol grease precursor composition from said container.

28. A pressurized aerosol grease precursor composition in a dispensing container according to claim 27 wherein said at least one grease precursor base oil comprises a substance selected from the group consisting of petroleum oils, synthetic hydrocarbons, napthenic oils, poly-alpha-olefins, mono-esters, di-esters, tri-esters, polyol esters, and mixtures of any two or more thereof.

29. A pressurized aerosol grease precursor composition in a dispensing container according to claim 27 wherein said at least one thickening agent comprises a substance selected from the group consisting of polyureas, lithium, aluminum complexes, calcium soaps, clays, and mixtures of any two or more of said thickening agents.

30. A pressurized aerosol grease precursor composition in a dispensing container according to claim 27 wherein said at least one propellant comprises a substance selected from the group consisting of isobutane, butane, propane, nitrogen, carbon dioxide, nitrogen dioxide, hydrofluorocarbons, dimethyl ether, HFC, HCFC and mixtures of any two or more of said propellants.

31. A pressurized aerosol grease precursor composition in a dispensing container according to claim 27 wherein said at least one propellant comprises from about 18% to about 90% of said aerosol grease precursor composition.

32. A pressurized aerosol grease precursor composition in a dispensing container according to claim 27 wherein said at least one grease precursor base oil and said at least one thickening agent taken together comprise from about 10% to about 82% of said aerosol grease precursor composition.

33. A method of dispensing an aerosol grease composition, said method comprising:

(a) obtaining a pressurized aerosol grease precursor composition in a dispensing container, said aerosol grease precursor composition consisting essentially of:

(i) a substantially unprocessed grease precursor composition, said grease precursor composition comprising:

(1) at least one grease precursor base oil; and (2) at least one thickening agent; and said grease precursor composition capable of forming a grease of an NLGI Grade in the range of 000 to 6 upon mechanical shearing attendant to aerosol spraying; and (ii) at least one propellant;

said aerosol grease precursor composition being substantially free of liquid organic solvents and being under a pressure greater than ambient atmospheric pressure; and said aerosol grease precursor composition disposed in a container adapted to contain said pressurized aerosol grease precursor, said container comprising an outlet and a valve to control the release of said pressurized aerosol grease precursor from said container; and (b) opening said valve so as to came said pressurized aerosol grease precursor composition to be released from said container whereby said grease precursor composition forms a grease.

34. A method according to claim 33 wherein said at least one grease precursor base oil comprises a substance selected from the group consisting of petroleum oils, synthetic hydrocarbons, napthenic oils, poly-alpha-olefins, mono-esters, di-esters, tri-esters, polyol esters, and mixtures of any two or more thereof.

35. A method according to claim 33 wherein said at least one thickening agent comprises a substance selected from the group consisting of polyureas, lithium, aluminum complexes, calcium soaps, clays, and mixtures of any two or more of said thickening agents.

36. A method according to claim 33 wherein said at least one propellant comprises a substance selected from the group consisting of isobutane, butane, propane, nitrogen, carbon dioxide, nitrogen dioxide, hydrofluorocarbons, dimethyl ether, HFC, HCFC and mixtures of any two or more of said propellants.

37. A method according to claim 33 wherein said at least one propellant comprises from about 18% to about 90% of said aerosol grease precursor composition.

38. A method according to claim 33 wherein said at least one grease precursor base oil and said at least one thickening agent taken together comprise from about 10% to about 82% of said aerosol grease precursor composition.

39. An aerosol grease precursor composition according to claim 3 wherein said thickening agent comprises from about 8% to about 20% of said aerosol grease precursor composition.

40. A pressurized aerosol grease precursor in a dispensing container according to claim 10 wherein said thickening agent comprises from about 8% to about 20% of said aerosol grease precursor composition.

41. A method according to claim 17 wherein said said thickening agent comprises from about 8% to about 20% of said aerosol grease precursor composition.

* * * * *

UNITED STATES PATENT AND TRADEMARK OFFICE

CERTIFICATE OF CORRECTION

PATENT NO. : 5,614,478
DATED : March 25, 1997
INVENTOR(S) : Stephen E. Gates

It is certified that error appears in the above-identified patent and that said Letters Patent is hereby corrected as shown below:

In column 2, line 39, please delete the symbol "." after 100° F.

In column 4, line 39, please delete the symbol "." after 100° F.

In column 4, line 63, please delete the number "0" after Vanlube and replace it with the letter --O--.

In column 5, line 44, please delete the word "propeller" and replace it with the word --propellant--.

In column 5, line 47, please delete the word "or" and replace it with the word --of--.

In column 6, line 10, please delete the symbol ":" and replace it with the symbol --;--.

In column 6, line 53, please delete the symbol ":" and replace it with the symbol --;--.

In column 7, line 48, please delete the word "conger" and replace it with the word --container--.

UNITED STATES PATENT AND TRADEMARK OFFICE

CERTIFICATE OF CORRECTION

PATENT NO. : 5,614,478
DATED : March 25, 1997
INVENTOR(S) : Stephen E. Gates

It is certified that error appears in the above-identified patent and that said Letters Patent is hereby corrected as shown below:

In column 8, line 5, please delete the letters "HFC".

In column 8, line 62, please delete the symbol ":" and replace it with the symbol --;--.

In column 9, line 25, please delete the letters "HFC".

In column 10, line 28, please delete the letters "HFC".

In column 10, line 45, after the word "said", please delete the word "said".

As to these errors, a review of the Amendments filed January 29, 1996, August 19, 1996 and October 9, 1996, confirm that the errors were made in the printing of the patent.

Signed and Sealed this

Twenty-third Day of September, 1997

*Attest:*

Bruce Lehman

BRUCE LEHMAN

*Attesting Officer*

*Commissioner of Patents and Trademarks*